US007354326B2

(12) United States Patent
Lukens

(10) Patent No.: US 7,354,326 B2
(45) Date of Patent: Apr. 8, 2008

(54) PERSONAL WATERCRAFT

(76) Inventor: William W. Lukens, 320 Gaskill St., Philadelphia, PA (US) 19147

( * ) Notice: Subject to any disclaimer, the term of this patent is extended or adjusted under 35 U.S.C. 154(b) by 390 days.

(21) Appl. No.: 11/128,983

(22) Filed: May 13, 2005

(65) Prior Publication Data

US 2006/0254488 A1 Nov. 16, 2006

(51) Int. Cl.
*B63B 35/83* (2006.01)
*B63B 43/14* (2006.01)

(52) U.S. Cl. ..... 441/76; 441/77; 114/123

(58) Field of Classification Search ..... 441/65, 441/68–73, 76–78; 440/21–25, 32; 114/61.15–61.19, 114/123
See application file for complete search history.

(56) References Cited

U.S. PATENT DOCUMENTS

| | | | | | |
|---|---|---|---|---|---|
| 1,693,867 | A | * | 12/1928 | Reinwald | 441/76 |
| 2,940,090 | A | * | 6/1960 | Fournier | 441/77 |
| 3,121,892 | A | | 2/1964 | Plumlee | 9/310 |
| 3,936,897 | A | | 2/1976 | Schaumann | 9/310 D |
| 3,952,353 | A | | 4/1976 | Word | 9/310 D |
| 4,034,430 | A | | 7/1977 | Joyce | 9/310 D |
| 4,037,280 | A | | 7/1977 | Klepsch | 9/310 D |
| 4,060,866 | A | | 12/1977 | Robinson | 9/310 D |
| 4,117,562 | A | | 10/1978 | Schaumann | 9/310 D |
| 4,129,912 | A | | 12/1978 | Robinson | 9/310 D |
| 4,157,597 | A | | 6/1979 | Trebnick | 9/310 D |
| 4,261,069 | A | | 4/1981 | Schaumann | 9/310 D |
| 4,459,118 | A | | 7/1984 | Schaumann | 441/76 |
| 4,530,668 | A | | 7/1985 | Braun | 441/76 |
| 4,541,809 | A | | 9/1985 | Schaumann | 441/76 |
| 4,591,343 | A | | 5/1986 | Schaumann | 441/76 |
| 4,698,039 | A | | 10/1987 | Watson | 441/77 |
| 4,731,039 | A | | 3/1988 | Zeiss | 441/76 |
| 4,846,743 | A | * | 7/1989 | Ping-chuan | 441/77 |
| 5,080,621 | A | | 1/1992 | Nayes | 441/77 |
| 5,120,249 | A | | 6/1992 | Fonda | 441/77 |
| 5,236,381 | A | | 8/1993 | Keogh | 441/77 |
| 5,417,179 | A | | 5/1995 | Niemier et al. | 114/347 |
| 5,429,538 | A | | 7/1995 | Hwu | 441/77 |
| 5,458,514 | A | | 10/1995 | Hsia | 441/77 |
| 5,558,553 | A | | 9/1996 | Okano | 441/76 |

(Continued)

FOREIGN PATENT DOCUMENTS

JP 01215693 A * 8/1989

(Continued)

*Primary Examiner*—Ajay Vasudeva
(74) *Attorney, Agent, or Firm*—Duane Morris, LLP

(57) ABSTRACT

A personal watercraft is disclosed comprising a pair of longitudinally connected pontoons suitable for supporting a user on the surface of a body of water. A slip-joint comprising a pair of concentric cylinders, one attached to each pontoon, provides desired lateral fixation between the pontoons while allowing relative longitudinal movement. Floating outriggers are provided to enhance the stability of the watercraft, and a set of hand rails helps the user balance on and operate the device. Paddle elements can be provided on the bottom surface of each pontoon to allow the user to operate the watercraft by using a striding motion similar to that used when cross-country skiing. The watercraft may have a rudder to help steer the craft, and it may also have a removable seat. A sail option is also provided. The pieces of the watercraft are removably connected to allow quick and easy assembly and disassembly, for transport to and from the water.

16 Claims, 11 Drawing Sheets

U.S. PATENT DOCUMENTS

| | | | | |
|---|---|---|---|---|
| 5,593,334 | A | 1/1997 | Thayer | 441/77 |
| 5,607,331 | A | 3/1997 | Lekhtman | 440/23 |
| 5,616,060 | A | 4/1997 | Morin | 441/76 |
| 5,697,822 | A | 12/1997 | Souter | 441/76 |
| 5,860,841 | A | 1/1999 | Welz | 441/76 |
| 6,595,813 | B1 | 7/2003 | Lekhtman | 440/21 |
| 6,764,363 | B2 | 7/2004 | Rosen | 441/77 |
| 2004/0166748 | A1 | 8/2004 | Rosen | 441/76 |

FOREIGN PATENT DOCUMENTS

| | | | | |
|---|---|---|---|---|
| JP | 03153491 | A | * | 7/1991 |
| JP | 09039884 | A | * | 2/1997 |

* cited by examiner

PERSONAL WATERCRAFT

FIELD OF THE INVENTION

The invention relates to watercraft in general, and more particularly to a personal watercraft that can be powered via the walking motions of a user, where the walking motions are translated to a pair of movable floats, one float associated with each leg of the user, the floats having a plurality of paddle members disposed on the bottom thereof to provide variable water resistance during operation.

BACKGROUND OF THE INVENTION

Water walking shoes are known to include a pair of buoyant floats having structures for assisting in propulsion. Prior devices, however, have failed to adequately balance the need for stability and efficient propulsion with the need for a simple device that is easy to construct and use. Typically, the more stable and efficient the device, the more complex its construction. Such devices can also be difficult to transport, since they can not be readily disassembled and reassembled by the user, which may be necessary in order to fit the device into or on a user's car or truck. Since many potential users may not live on a body of water, this transportability may make the difference in whether or not the device will be used.

Thus, there is a need to provide a simple design for a user-powered watercraft which is inherently stable and easy to use. There is also a need for a user-powered watercraft which can be easily assembled and disassembled for practical transportation to and from the water.

SUMMARY OF THE INVENTION

A personal watercraft is disclosed, comprising first and second flotation members, each flotation member having a longitudinal axis, an inboard coupling edge, a lower water engaging surface and an upper user support surface. The upper user support surface of each element can be configured to support a user's foot thereon. First and second floating outriggers can be connected to respective first and second flotation members by respective outrigger supports, said floating outriggers being laterally spaced from their respective floatation elements. First and second hand-supports can be provided, associated with the first and second flotation members, each of said hand supports comprising a flotation member-connecting portion and a user-gripping portion. The inboard coupling edges of the first and second flotation members can be configured to interconnect so as to enable relative sliding movement of the flotation members in a direction substantially parallel to the longitudinal axis of each flotation member, but to prevent substantial movement of the first and second elements in a direction perpendicular to said longitudinal axis.

A personal watercraft is disclosed, comprising first and second flotation pontoons, each pontoon having a longitudinal axis, an inboard edge, a lower water engaging surface and an upper user support surface, said upper user support surface of each element being configured to support a user's foot thereon. First and second outriggers can be provided, connected to respective first and second pontoons by outrigger supports. First and second fixed hand-supports can also be provided, associated with the first and second flotation elements, each of said fixed hand supports comprising a pontoon connecting end and a user-gripping end. The first and second pontoons are connected via a slip-joint connection comprising a hollow longitudinally oriented outer member connected to the first pontoon and a longitudinally oriented inner member connected to the second pontoon, the inner member sized and configured to be received within the outer to enable relative sliding movement of the first and second pontoons parallel to the longitudinal axis of each pontoon, and to prevent substantial movement of the first and second pontoons in a direction perpendicular to said longitudinal axis.

BRIEF DESCRIPTION OF THE DRAWINGS

Other objects, advantages and novel features of the invention will become more apparent from the following detailed description of the invention when considered in conjunction with the accompanying drawings, wherein.

DETAILED DESCRIPTION

Figure 1:
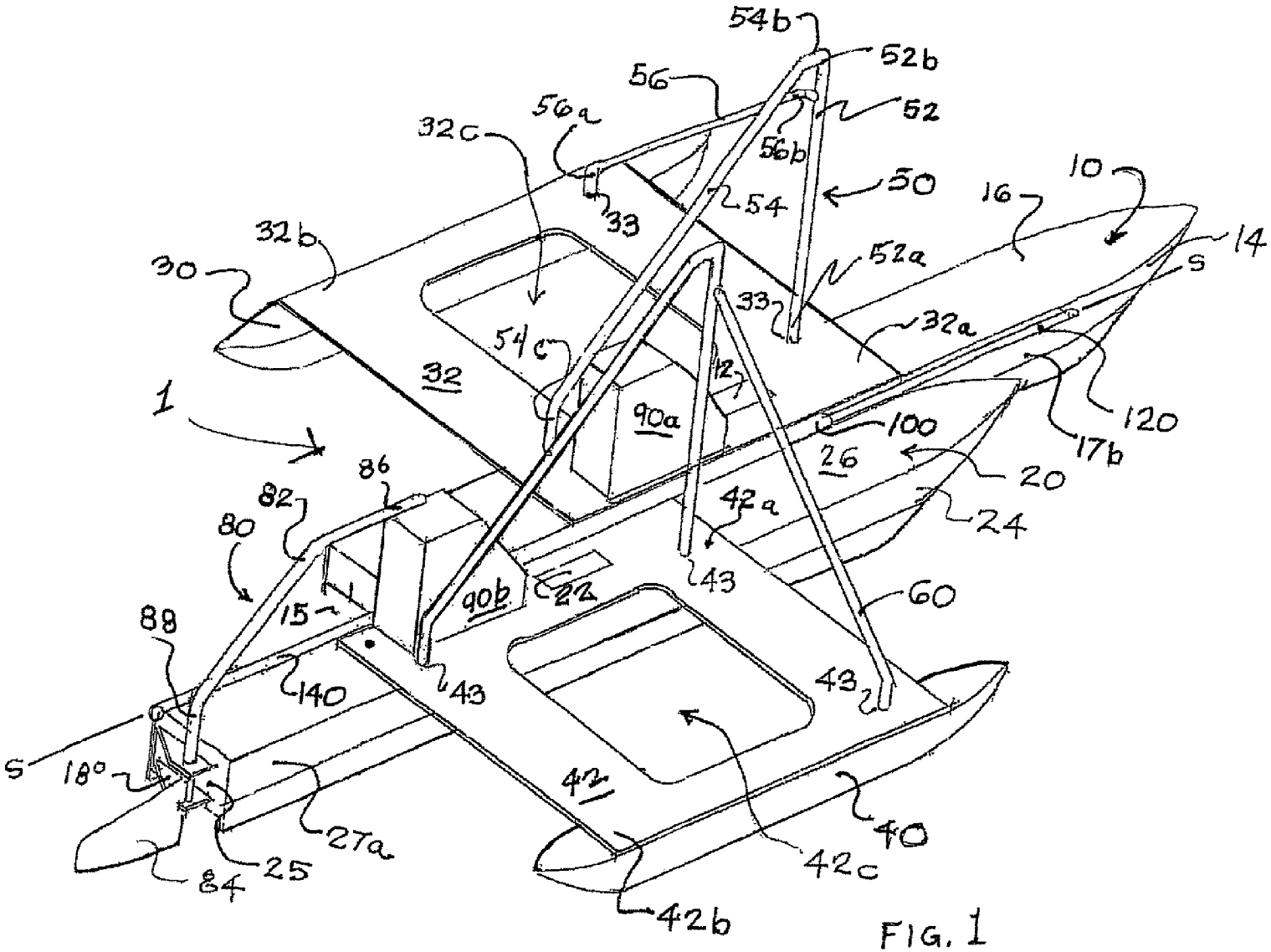
FIG. 1 is an isometric view of the inventive watercraft.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 2:
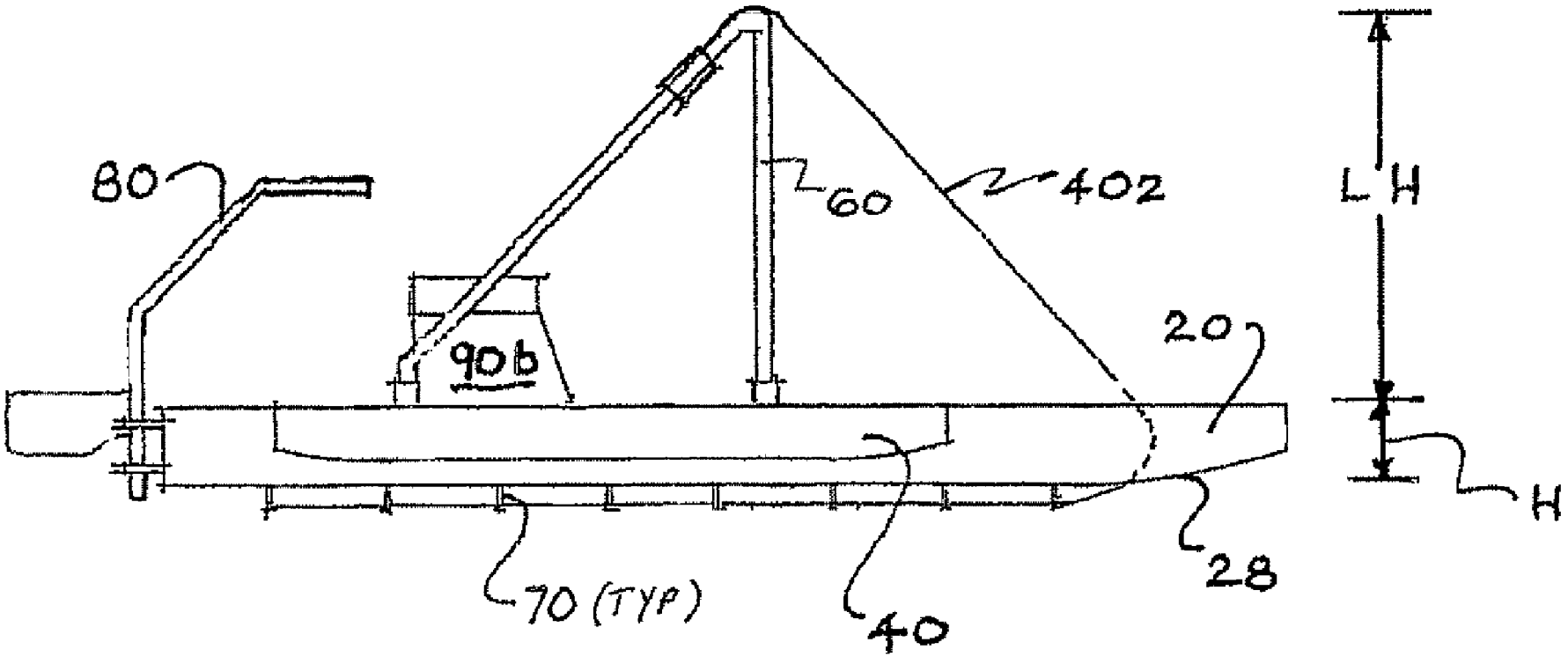
FIG. 2 is a side view of the watercraft of FIG. 1.
Figure 3:
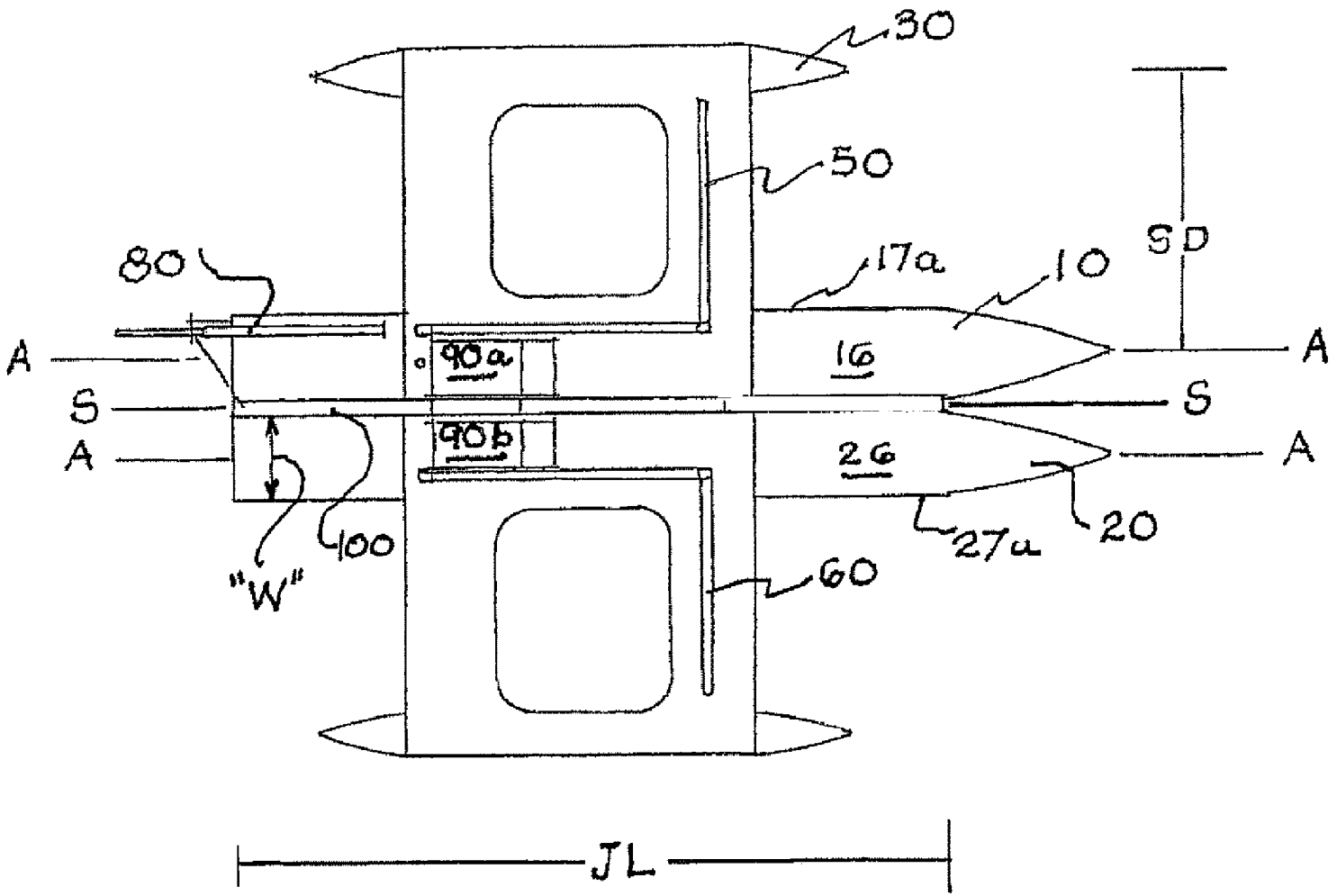
FIG. 3 is a top plan view of the watercraft of FIG. 1.

Referring to FIGS. 1-3, a watercraft 1 is provided that allows a user to travel across the surface of a body of water using a striding motion similar to that used when cross-country skiing. The watercraft 1 has a pair of interconnected flotation elements, or pontoons 10, 20, suitable for supporting an adult on the surface of a body of fresh or salt water. The user can stand on the watercraft 1 with one foot on each pontoon 10, 20, and can grasp a pair of hand support railings 50, 60, which are provided with each pontoon 10, 20, to enable the user to maintain balance while operating the watercraft 1. An outrigger 30, 40 is provided with each pontoon 10, 20 to enhance the overall stability of the watercraft and make it easier to balance and operate, especially for inexperienced users. One or more paddle elements 70 can be provided on the bottom of each pontoon to regulate the fluid resistance across the bottom surface of the pontoons, thus facilitating movement of the watercraft 1 through the water using the previously described striding motion. A rudder 80 can be provided on an aft portion of one of the pontoons 10, 20 to allow easy steering of the watercraft, and one or more seat members 90*a, b* can also be provided on the pontoons to allow the user to sit down. Preferably, the individual elements of watercraft 1 will be fit together in a manner that makes the watercraft quickly assembled and disassembled for ease of transport and use.

Referring again to FIGS. 1-3, pontoons 10, 20 can be sized to support an average adult on the surface of the water. The pontoons 10, 20 can have a generally streamlined elongated appearance similar to the hull of a boat, with a tapered forward portion 14, 24 to allow the pontoons to efficiently cut through the water. The top 16, 26 and bottom 18, 28 surfaces of each pontoon 10, 20 can be generally flat over substantially the entire length "L" of the pontoon. An exception may be the tapered forward portion 14, 24 of each pontoon, which can be rounded or otherwise angled to reduce fluid resistance at the forward end of the watercraft 1. The aft end 15, 25 of each pontoon can be flat or have any other appropriate shape to facilitate attachment of a rudder assembly 80 as will be described in more detail later. In one embodiment, the pontoons 10, 20 have a length "L" of about 8 feet, a width "W" (FIG. 3) of about 12-inches, and a height "H" (FIG. 2) of about 8-inches. Thusly dimensioned, the watercraft 1 will support a person weighing about 250 pounds at a pontoon draft of about 3 inches.

The pontoons 10, 20 can be made of fiberglass or other highly buoyant material suitable for supporting the weight of the watercraft and user. In one embodiment each pontoon comprises three 2" thick foam glass rigid insulation boards glued together using a suitable waterproof adhesive, such as Liquid Nails® brand adhesive. Generally, the surfaces that will be in contact with the water should be water-resistant or waterproof, and they preferably they will also be very smooth so as to minimize fluid resistance during operation.

Where a soft material, such as foam glass boards, is used to form the pontoons, the sides 17*a, b*; 27*a, b* of the pontoons 10, 20 can be sheathed with a layer of protective material 117, 127 (FIG. 4), such as plywood, to prevent damage due to impacts with docks or other water borne objects, and from abrasion due to contact with the adjacent pontoon during operation. This sheathing can be applied using waterproof adhesive as previously noted. The sheathing 117, 127 can extend below the bottom surface 18, 28 of the pontoons 10, 20 by a distance "KL", thereby functioning as keels to minimize unwanted lateral movement of the watercraft 1 through the water. In one embodiment, the distance KL is about 1.5 inches.

Footpad areas 12, 22 can be provided on the top surfaces of the outrigger supports 32, 42 overlying respective pontoons 10, 20. These footpad areas preferably will be located so that when standing on them the user is positioned directly over the pontoons and at approximately the midpoint of the watercraft 1, thus achieving a desired balanced distribution of weight across the craft. The footpad areas 12, 22 also may comprise a non-skid or other friction enhancing material, such as a sand finish, to maximize engagement between the pontoons and the user's feet or shoes, even under conditions in which the footpad areas 12, 22 become wet.

In an alternative embodiment, a partial or full boot element (not shown) could be provided on the top of each pontoon in the same location as the foot pad areas. Such boot elements are well known for use with waterskis, and may be advantageous because they can provide positive engagement between the user's feet and the pontoons, reducing or eliminating the need for frictional engagement. In one embodiment, instead of a boot, a single raised surface element (not shown) may be provided immediately aft of each footpad area to act as a heel support for allowing the user to brace his or her foot during the rearward portion of the striding motion, since this is the motion which will most require such support.

Although the pontoons have been described as being fabricated from a pair of rigid foam insulation boards, other materials and configurations are also possible. For example, molded hollow plastic, fiberglass or polypropylene materials could be used for maximum strength and durability. Furthermore, to minimize weight, the pontoons could be either partially or fully inflatable.

Figure 4:
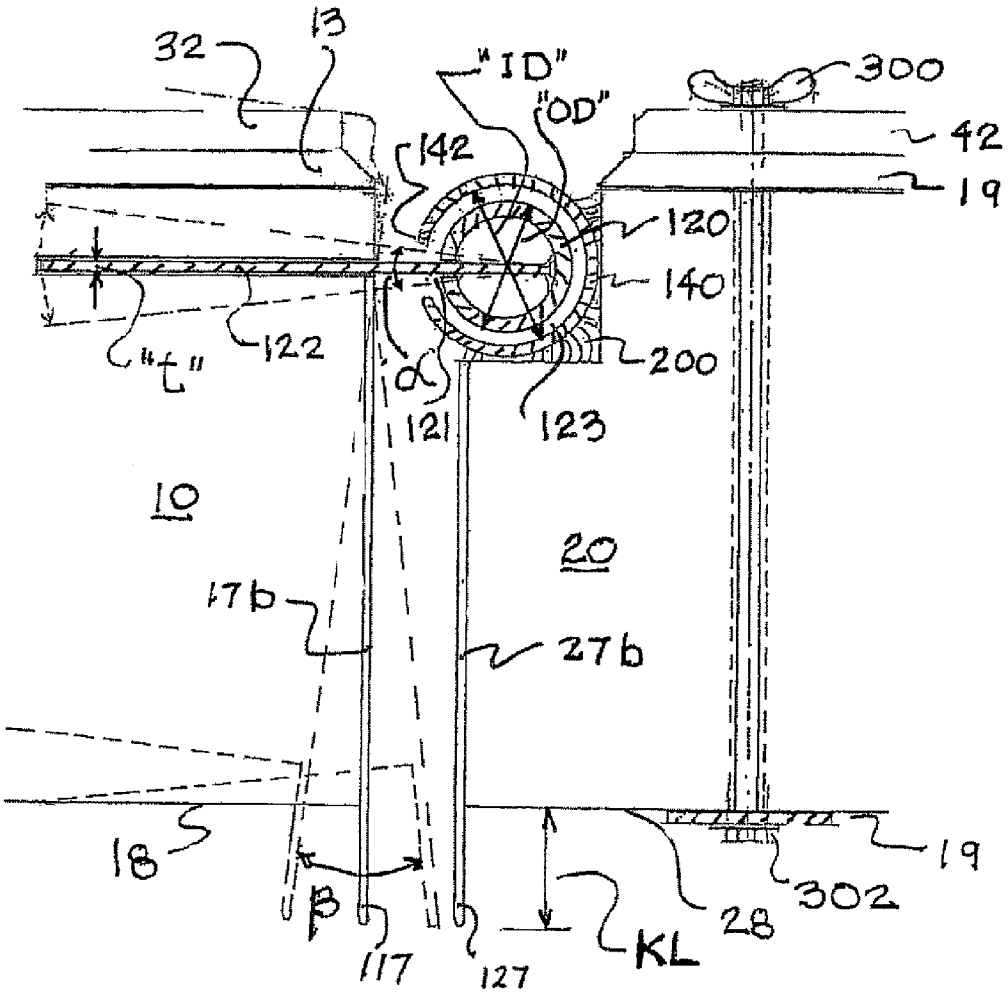
FIG. 4 is a cross-section view of a coupling joint linking adjacent float members of the watercraft of FIG. 1.

As illustrated in FIGS. 1-3, and shown in more detail in FIG. 4, the pontoons can be interconnected via a slip-joint 100 having a joint axis "S-S", which enables the pontoons 10, 20 to move with respect to each other in a direction substantially parallel to the longitudinal axis "A-A" (FIG. 3) of each pontoon 10, 20, but which prevents relative lateral movement or separation. The slip joint 100 can have a length "JL" running substantially the entire length of the pontoons 10, 20 (slightly less where the front portions 14, 24 of the pontoons are tapered or rounded). In one embodiment this length "JL" can be about 6 feet. This arrangement allows the user to undertake the striding motion necessary to power the watercraft, while preventing the pontoons 10, 20 from laterally separating. This simplifies operation of the craft since the user needn't expend energy (and needn't have the required balance and leg strength) to maintain the pontoons at the desired lateral spacing. This is particularly important for new users, or for users who lack the substantial coordination or strength required to maintain such an offset.

The slip-joint 100 can comprise a pair of generally concentric cylindrical elements 120, 140 which are connected to respective pontoons 10, 20. As can best be seen in FIG. 4, inner cylindrical element 120 has an outer diameter "OD" that is less than the inner diameter "ID" of outer cylindrical element 140 so that the inner cylindrical element can fit within, and slide with respect to, the outer cylindrical element. In the illustrated embodiment, the outer cylindrical element 140 is secured to pontoon 20 by adhesive 200, while the inner cylindrical element 120 is secured to pontoon 10 via a flat planar member 122 which itself is sunken into the body of the pontoon material and adhered thereto using waterproof adhesive. The planar member 122 fits through a longitudinal slit 121 in the inner cylindrical element 120 and is adhered within the slit and is also adhered to the inner surface 123 of the element using waterproof adhesive. Thusly arranged, each of the cylindrical elements is firmly fixed to its respective pontoon without freedom to move or rotate with respect thereto.

A small longitudinally disposed slit 142 is provided along the entire length of the outer cylinder 140 to accommodate the flat planar member 122 attached to the inner cylindrical element 120. The slit 142 preferably has a width "sw" sized to be larger than the thickness "t" of the planar member 122 by an amount sufficient to prevent binding of the planar member and the slit surfaces. It also permits the cylinders 120, 140 to rotate slightly relative to each other about the slip joint axis S-S by an angle $\alpha$ (FIG. 4). This allows the pontoons 10, 20 to rotate slightly with respect to each other by an angle $\beta$ that is equal to angle $\alpha$. This relative angulability, in addition to preventing binding of the sliding surfaces, is also important because it allows the pontoons to assume different relative vertical positions in the water, which will occur as the user shifts his/her weight from one foot to the other due to the aforementioned striding motion. This slight rotational freedom between the pontoons will minimize the stresses and forces on the slip joint 100 because substantially no moment will be created about the joint axis S-S during operation.

In one embodiment, slit 142 runs the entire length "CL" of the outer cylinder element 140 and has a width "sw" of about ¼-inch to about 1-inch, and preferably about ½-in Planar member 122 has a thickness "t" of about ⅛-inch, thus allowing a total relative angulation $\alpha$, $\beta$ between the cylinders/pontoons of about 15 degrees. These values are merely exemplary, and others could be used as appropriate.

It should be noted that while it is important that slit 142 be large enough so as not to bind with the planar member 122, it also should not be so large that it changes the manner in which the inner and outer cylinders 120, 140 mate (i.e. changes the sliding interaction between the two smooth cylindrical members from that of a curved surface on a curved surface to that of a line contact between the inner cylindrical member and the edges of the slit. If too large a slit is provided, this line contact could result in galling of the bearing surfaces, which will result in decreased efficiency and performance of the slip joint.

In one embodiment, the outer cylinder is a 2-inch ID schedule 40 PVC pipe, and the inner cylinder is a 1¼ inch ID schedule 40 PVC pipe. To minimize friction and wear between the cylinders, a lubricant, such as a polytetrafluoroethylene (PTFE) spray (commonly sold as Teflon® brand spray) can be applied between the cylinders during assembly. Alternatively, light weight metal tubes coated with a lubricant such as PTFE could be used for the inner and outer cylindrical elements 120, 140. In one alternative embodiment, the tubes could be made of PTFE-coated aluminum. It is expected that if light weight metal tubes were used, they could be substantially smaller (thinner) and lighter due to difference in strength between metals and PVC.

It is also noted that although the slip-joint is described as comprising a pair of cylindrical members, that other shapes could be used, such as oval, rectangular, etc. Additionally, the inner element 120 needn't be hollow, but instead could be solid.

Referring again to FIG. 1, a pair of outriggers 30, 40 can be provided to enhance stability of the watercraft 1. These outriggers 30, 40 can be constructed from the same or similar materials to those used for the pontoons 10, 20 such that they will float on the surface of the water and will provide the desired degree of stabilization. They may also have a generally tapered bow shape similar to that of the pontoons to facilitate movement through the water.

The outriggers 30, 40 can be positioned a lateral distance "SD" (FIG. 3) from their respective pontoons to provide the desired stability to the watercraft 1. In one embodiment, this distance SD is about 3 feet. As shown in FIG. 1, individual outrigger supports 32, 40 are provided to connect each outrigger to its respective pontoon. These supports 32, 42 can be generally planar members having first and second ends 32*a,b*; 42*a, b*, with the first end 32*a*, 42*a*, fixed to the pontoon 10, 20 and the second end 32*b*, 42*b* fixed to the outrigger 30, 40. The supports 32, 42 each can have a central cutout 32*c*, 42*c* to reduce the overall weight of the watercraft 1 without adversely affecting the strength and stiffness of the supports. The outrigger supports can be fabricated from any suitable material, such as plywood, plastic, fiberglass, or the like. Where cutouts are provided, a mesh netting or other lightweight material can be used to loosely cover the cutouts and can be used to hold items such drinks, sun-tan lotion, etc.

Figure 5B:
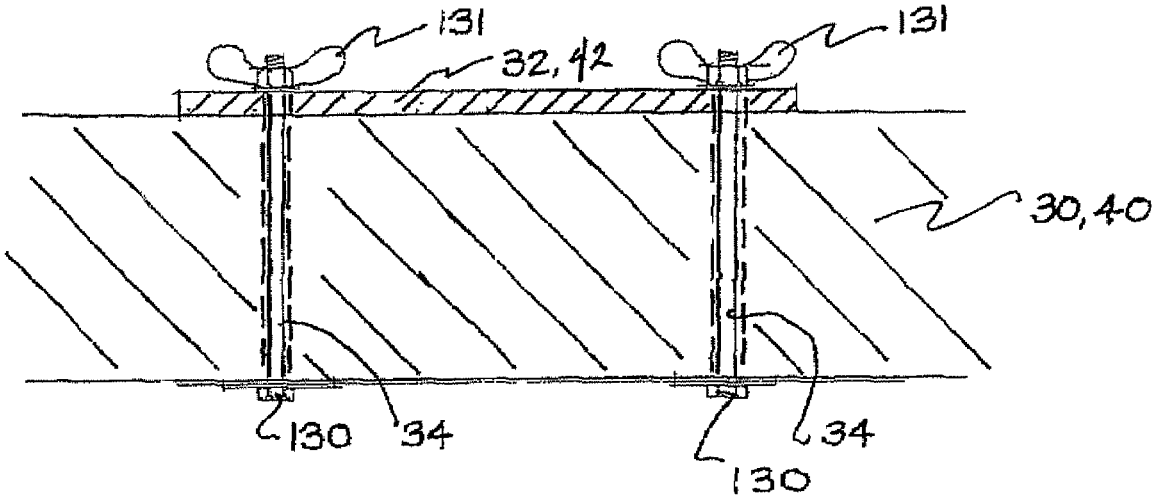
FIG. 5B is a partial cross-section view of the connection between an outrigger support and an outrigger of the watercraft of FIG. 1.
Figure 5A:
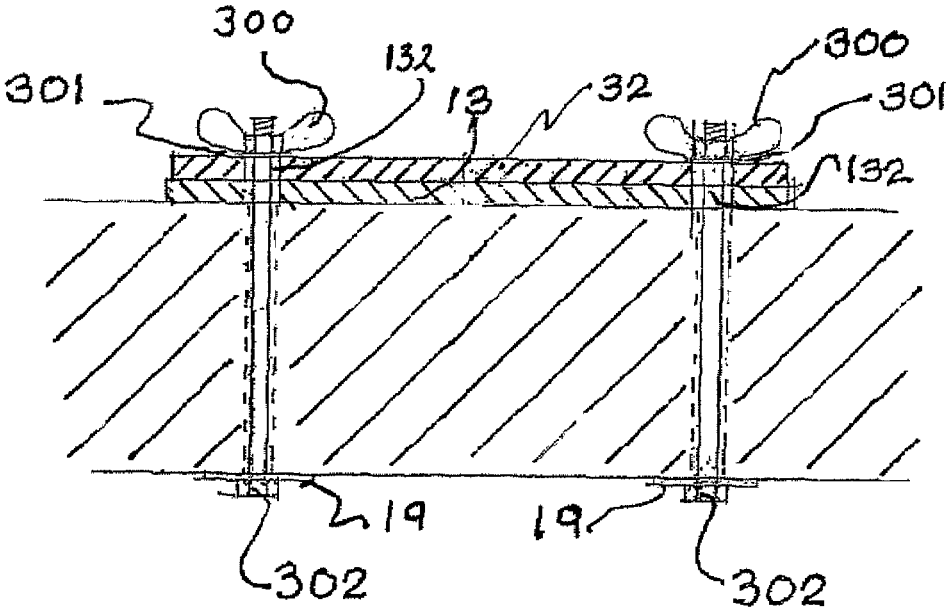
FIG. 5A is partial cross-section view of the connection between an outrigger support and a pontoon of the watercraft of FIG. 1.

As shown in detail in FIGS. 5A and 5B, the supports 32, 40 are fixed to the top surfaces of their respective outrigger and pontoon using a removable bolt configuration. For simplicity, the connections will be described in relation to pontoon 10 and outrigger support 32, however, it will be appreciated that the same arrangement will be used for connecting outrigger support 42 to pontoon 20. The connection between support 32 and pontoon 10 is shown in FIG. 5A, in which second and third sheathing layers 13, 19 are provided on the top 16, 26 and bottom 18, 28 surfaces of each pontoon 10, 20, to provide support for a pair of nut 300 and bolt 302 combinations positioned adjacent the forward and aft ends of the outrigger support 32 where the support overlies the pontoon 10. As can be seen, a pair of holes 132 are drilled in the outrigger support 32 to overlie similar holes 110 in the pontoons, and bolts 302 are threaded through the holes so that the bolt heads rest on the third sheathing layer 19. The bolts should be sized so that a portion of the shank of each bolt will protrude upward through the holes in the second sheathing layer 13 and outrigger support 32. The nuts 300 engage the bolts and are tightened to fix the support 32 to the pontoon 10. Washers 301 may be provided to resist pull-through of the bolts/nuts or to prevent damage to bearing surfaces. In the illustrated embodiment, nuts 300 comprise wing nuts that can be easily tightened/untightened by hand, thus facilitating easy installation and disassembly of the supports from the pontoons.

As illustrated in FIG. 5B, similar bolt and wing nut connections 130 can be provided to removably attach the outriggers 30, 40 to the outrigger supports 32, 42. Due to the smaller size of the outriggers as compared to the pontoons, the additional sheathing layers 13, 19 provided on the pontoons 10, 20 needn't be used with the outriggers 30, 40. Again, it will be appreciated that the provision of bolted connections for the outrigger supports will enable the user to easily disassemble the outriggers and supports from the pontoons for easy transport of the watercraft 1.

Although the outrigger supports 32, 42 are illustrated as being monolithic planar members, alternative arrangements could also be used. Thus, each outrigger could be connected to the respective pontoon using a plurality of spar members. Additionally, further weight savings could be realized by manufacturing the supports from, for example, aluminum or fiberglass tubing. Additionally, alternative connection hardware such as quick connect nuts (e.g. speed nuts) or other quick connection hardware could be substituted for the wing nuts described to provide the desired easy assembly/disassembly of the component pieces of the watercraft 1.

Figure 6A:
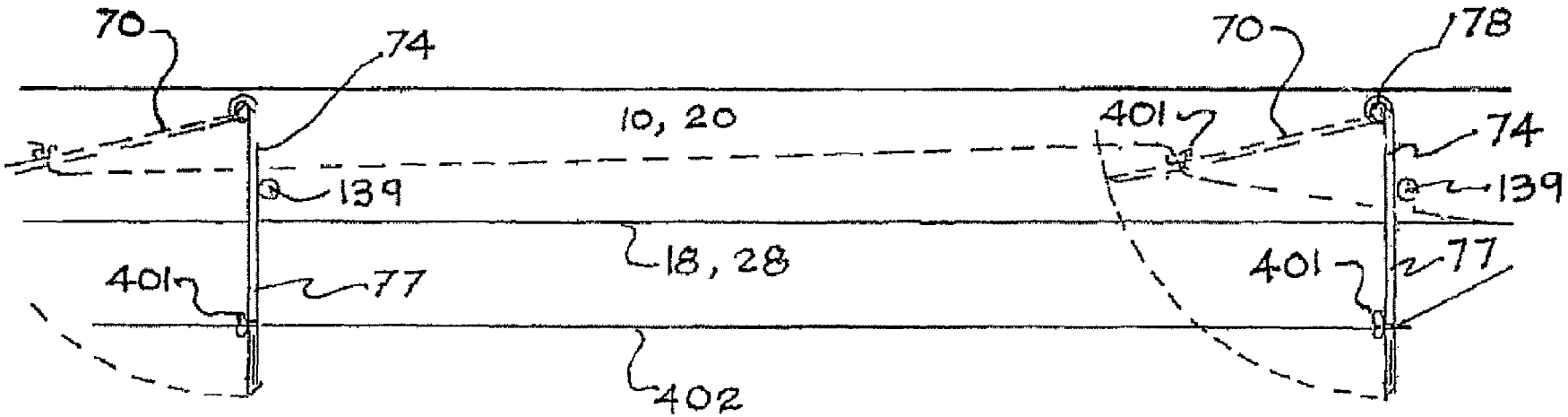
FIG. 6A is a side section view of a pair of paddle members and a float member of the watercraft of FIG. 1.

Referring to FIGS. 2, 6A, B and 7, a plurality of movable paddle elements 70 can be disposed on the bottom of each of the pontoons 10, 20 to provide controlled resistance to fluid flow over the bottom surfaces 18, 28 of the pontoons. The paddle elements 70 can be automatically rotatable with respect to the pontoons so that they assume a retracted, or generally horizontal, position when the associated pontoon is being moved forward, but assume an extended, or generally vertical, position when the pontoon is being moved rearward. This arrangement will advantageously provide increased fluid resistance on the backstroke and reduced fluid resistance on the forward stroke, thereby facilitating movement through the water using the described striding motion.

Figure 6B:
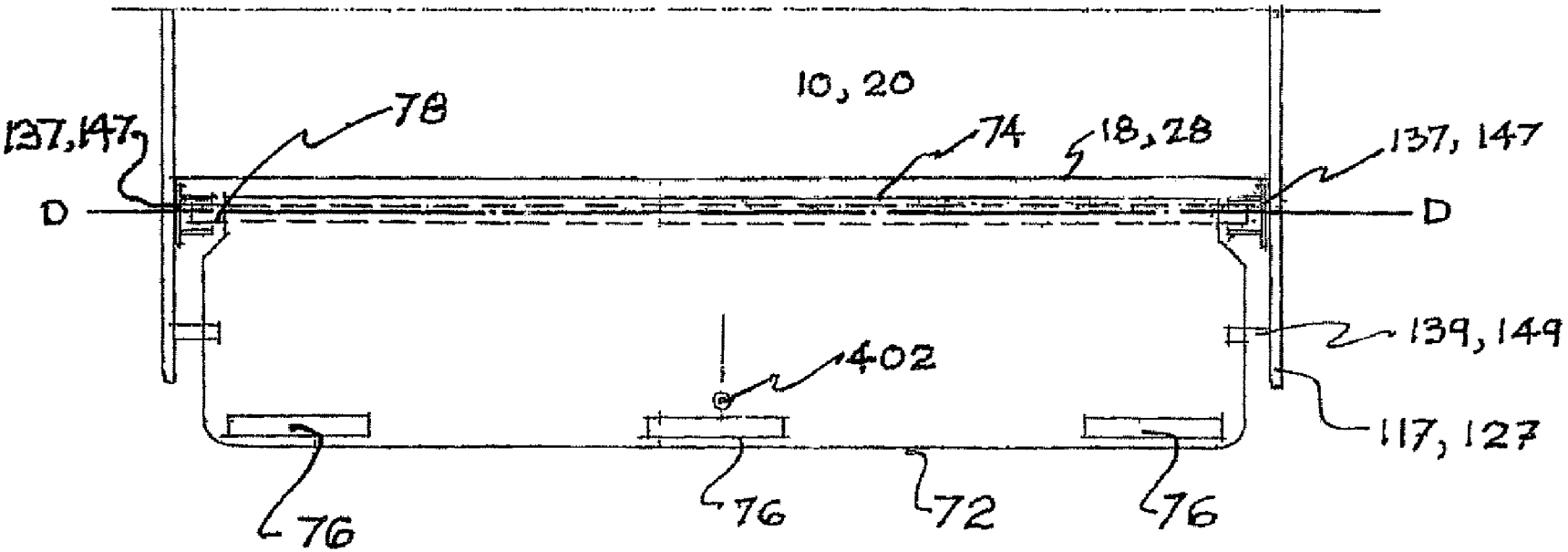
FIG. 6B is an end section view of one of the paddle members and the float member of FIG. 5A.

As shown in more detail in FIGS. 6A and 6B, each paddle element 70 can have a free end 72 and a pontoon engaging end 74. For simplicity, the paddles and their connections will be described in relation to pontoon 10, although it will be appreciated that the same arrangement will be used for connecting paddles 70 to pontoon 20. The pontoon engaging end 74 may have one or more laterally disposed rod elements 78 fixed thereto and configured to be rotatably received in corresponding socket elements 137 which are fixed to an inboard surface of the sheathing 117 at a point where the sheathing extends below the bottom surface 18 of the pontoon 10. The socket elements 137, are preferably oriented so that the axis "D-D" of the rod elements 78 is substantially perpendicular to the pontoon axis "A-A." A pair of stop elements 139 can be fixed to the sheathing 117 at a point below the socket elements 137 and just forward of the paddle elements 70. These stop elements 139 can serve to maintain the paddles 70 in a substantially vertical orientation (the configuration of FIG. 6A) during the rearward stroke of the pontoon 10 by contacting the forward surface 77 of the paddle.

During the forward stroke of the pontoon 10, fluid forces will cause the paddles 70 to rotate about the rod elements 78 to assume an approximately horizontal configuration (shown in phantom in FIG. 6A) so that they fit against the bottom surface 18 of the pontoon 10. During the rearward stroke, fluid forces will cause the paddles 70 to rotate in the reverse direction about the rod elements 78 until the paddles contact stop elements 139 and assume the approximately vertical configuration of FIG. 6A.

As noted, this rotatable configuration results in maximum fluid resistance for the pontoon during its rearward stroke, when the paddles assume a substantially vertical position, and provides minimum fluid resistance for the pontoon during its forward stroke, when the paddles assume a generally horizontal position. The path of rotation for each of the paddles 70 is illustrated by the dashed lines shown in FIG. 6A.

Each paddle element 70 may also be provided with one or more weights 76 located on or embedded in, or attached to the surface of, the paddle element near its free end 72. These weights 76 can cause to tend toward their vertical orientation (FIG. 6A) once the forward stroke is completed to thereby ensure that they will reliably engage the water during the rearward stroke. This weighting may be necessary because the paddles can be made of light-weight materials, it is possible that one or more of the paddles could "hang-up" and might not redeploy or extend during the rearward stroke, resulting in a loss of efficiency.

Figure 7:
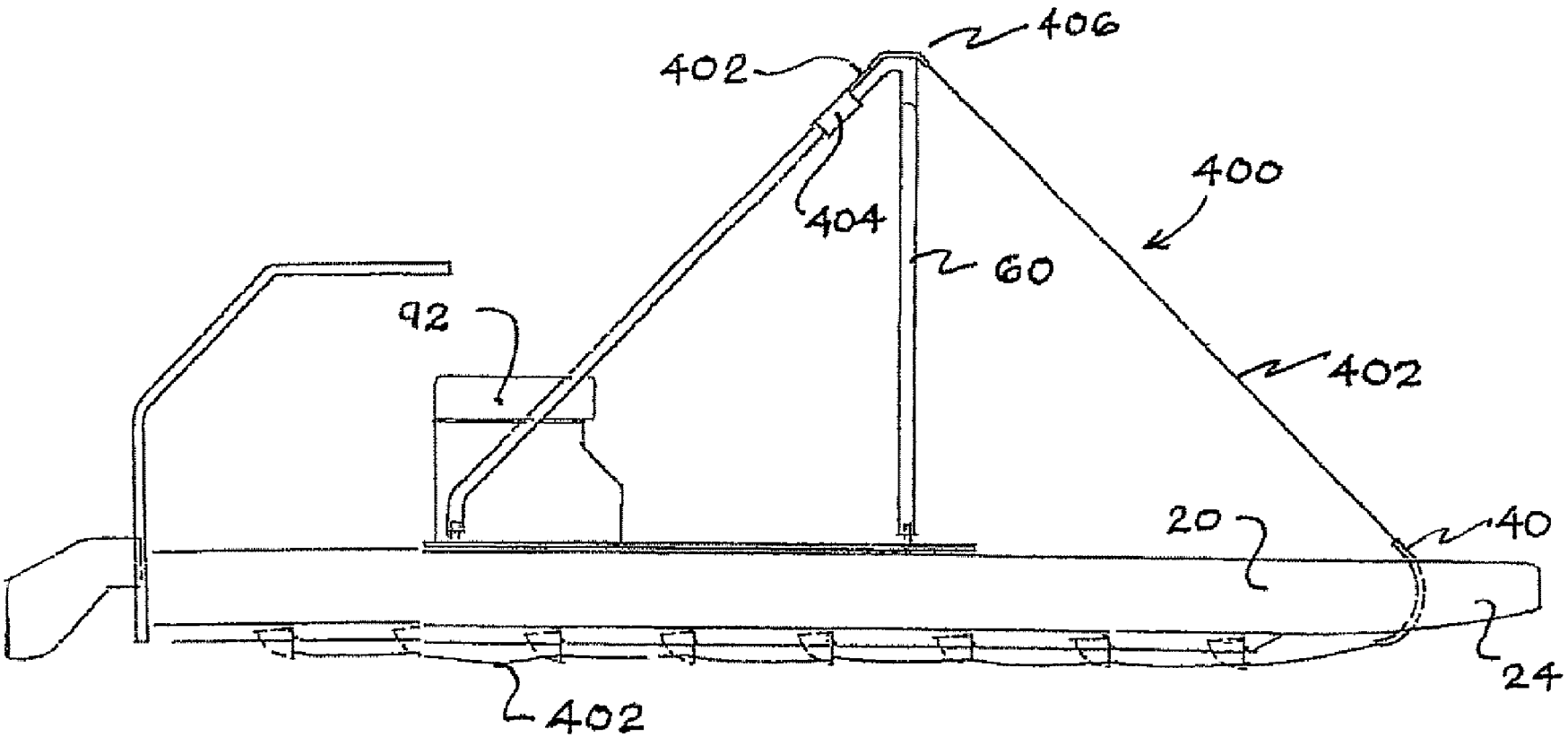
FIG. 7 is a cross-section view of the device of FIG. 1, taken through one of the pontoons.

Referring to FIG. 7, the watercraft 1 may be provided with a manual paddle actuation system 400, which, when operated, can cause all of the paddles 70 of a selected pontoon 10, 20 to be locked in the vertical position regardless of whether the pontoon is undergoing a forward or rearward stroke. This system can be advantageous because it can be utilized to help user quickly turn the watercraft around in the water using a reverse stroking motion, since it allows the paddle elements 70 to remain extended even during a forward stroking motion of the pontoon, where the force of the water would normally tend to rotate the paddles rearward to assume their horizontal position. Thus, with the paddles 70 of both pontoons 10, 20 extended, the user can apply a forward moving stroke with one pontoon and a reverse moving stroke with the other pontoon, thus causing the watercraft 1 to rotate in place. This functionality may be of great advantage where the available turning space is limited.

Separate but identical actuation systems can be provided for each pontoon, and each actuation system 400 can comprise a flexible cord 402, such as nylon, which is fixed to each individual paddle element 70 of the associated pontoon to allow the user to apply a forward force to each element 70 sufficient to overcome any fluid forces tending to push them rearward. As illustrated, a first portion of the cord 402 lies below its respective pontoon and connects individually to each paddle element 70 via individual stop elements 401. In one embodiment, these stop elements can be knots in the cord, although an appropriate clamping device could also be used. At its opposite end, the cord 402 is connected to a sleeve 404 which is slidably disposed on an upper portion of the respective railing 50, 60 so that it can be easily grasped by the user. A pair of cord guides 406, 408 may also be provided, one on the top of the railing and one within the forward end 14, 24 of each pontoon. These guides 406, 408 can operate to maintain proper position of the cord 402 during operation, and can also serve to minimize wear on the railing and pontoon due to the repetitive movement of the cord.

The cord guides 406, 408 can comprise curved plastic or metal tubes, and in one embodiment the cord guides 406, 408 comprise ¼-inch O.D. chromium plated copper tubes. Guide 406 can be fixed to the top portion of its respective railing 50, 60 while guide 408 can be embedded within the forward portion 14, 24 of the respective pontoon. Both guides can be fixed to their respective structures using waterproof adhesive, as previously described. Alternatively, the guides could be fabricated as integral portions of the railings and pontoons.

In operation, the user can manually actuate the paddles 70 of a selected pontoon 10, 20 by simply grasping the associated sleeve 404 and pulling downward. This will impart a tension in the cord 402, causing a forward movement (or will restrict rearward movement) of the paddles 70 of the selected pontoon, again owing to the individual connections between the cord 402 and the paddle elements 70. Once the user releases the sleeve 404, the paddles return to their normal operational mode. It is contemplated that a ratchet or other locking mechanism could be provided for the sleeve to allow the user to actuate it and lock it in the actuated configuration, thus eliminating the need for the user to continually hold down on the sleeve.

To make the watercraft 1 easier to operate, hand railings 50, 60 may be provided for one or both pontoons 10, 20. These railings can be of particular advantage for new users, or for users with reduced coordination or leg strength, because it eliminates the need for the user to balance his/her center of gravity when moving the pontoons 10, 20 back and forth using the previously described striding motion. Providing railings also enables to user to apply upper body (e.g.

arm and shoulder) forces to propel the watercraft 1 by pulling and pushing with one's hands against the railings 50, 60, thereby augmenting the forces applied to the pontoons 10, 20 by the user's feet.

In embodiment illustrated in FIG. 1, the railings 50, 60 provide longitudinal as well as lateral support, comprising a tripod arrangement associated with each pontoon and outrigger pair. Thus, each railing 50, 60 may have three separate support legs, including a forward vertical leg 52 and first and second diagonal legs 54, 56. The forward vertical leg 52 and the first diagonal leg 54 may form a substantially V-shaped support as viewed from one side of the watercraft 1, thus providing the aforementioned longitudinal support. The forward vertical leg 52 and the second diagonal leg 56 may combine to form a substantially V-shaped support as viewed from an end of the watercraft 1, thereby providing the aforementioned lateral support. The bottom ends 52*a*, 54*a*, 56*a* of each of the leg 52, 54, 56 can be connected to the associated outrigger support 32 via a pinned socket connection 33 (43 for railing 60 and outrigger support 42), which can allow quick assembly and disassembly of the railing and outrigger support.

As illustrated, the bottom end 52*a* of the vertical leg 52 connects to the outrigger support near its first end 32*a*, while the bottom end 54*a* of the first diagonal leg 54 connects to the outrigger support near its second end 32*b*. Likewise, the bottom end 56*a* of the second diagonal leg 56 connects to the first end 32*a* of the outrigger support 32 at a location substantially overlying the associated outrigger 30. The top ends 52*b*, 54*b*, 56*b* can be connected to each other to form the desired "tripod" structure. In one embodiment, the railings 50, 60 are formed from individual PVC pipes, and are interconnected using standard PVC pipe fittings. In one embodiment, the vertical leg has a height "LH" of about 3 feet 6-inches. As will be appreciated, however, alternative structural elements such as metal or fiberglass tubular or solid members could also be used.

In use, the user will grasp the first diagonal leg 54 at a comfortable position, and a friction enhancing gripping surface may be provided along an appropriate portion of the leg 54. This diagonally oriented gripping surface allows the user to assume a relatively natural and thus comfortable hand position while operating the watercraft 1.

The watercraft 1 may have a rudder assembly 80 to allow the user to adjust the direction of movement of the craft through the water, or to more easily maintain straight line movement under windy or high current conditions. As illustrated in FIG. 1, the rudder assembly 80 may comprise a plate element 84 connected to a handle 82. The handle may have a generally horizontally oriented gripping portion 84 which is positioned behind the user so as to be easily grasped when the user stands on the footpad areas 12, 22. Opposite the gripping portion 84, the handle 82 may have a vertical portion 88 which engages the plate element 84 and which is rotatably coupled to a fixture 180 which connects the rudder 80 assembly to the aft end 15, 25 of the pontoon. The rotational position of the plate element 84 can be changed by grasping the gripping portion 84 and rotating it about the axis of the vertical portion 88 by the desired amount.

Figure 8:
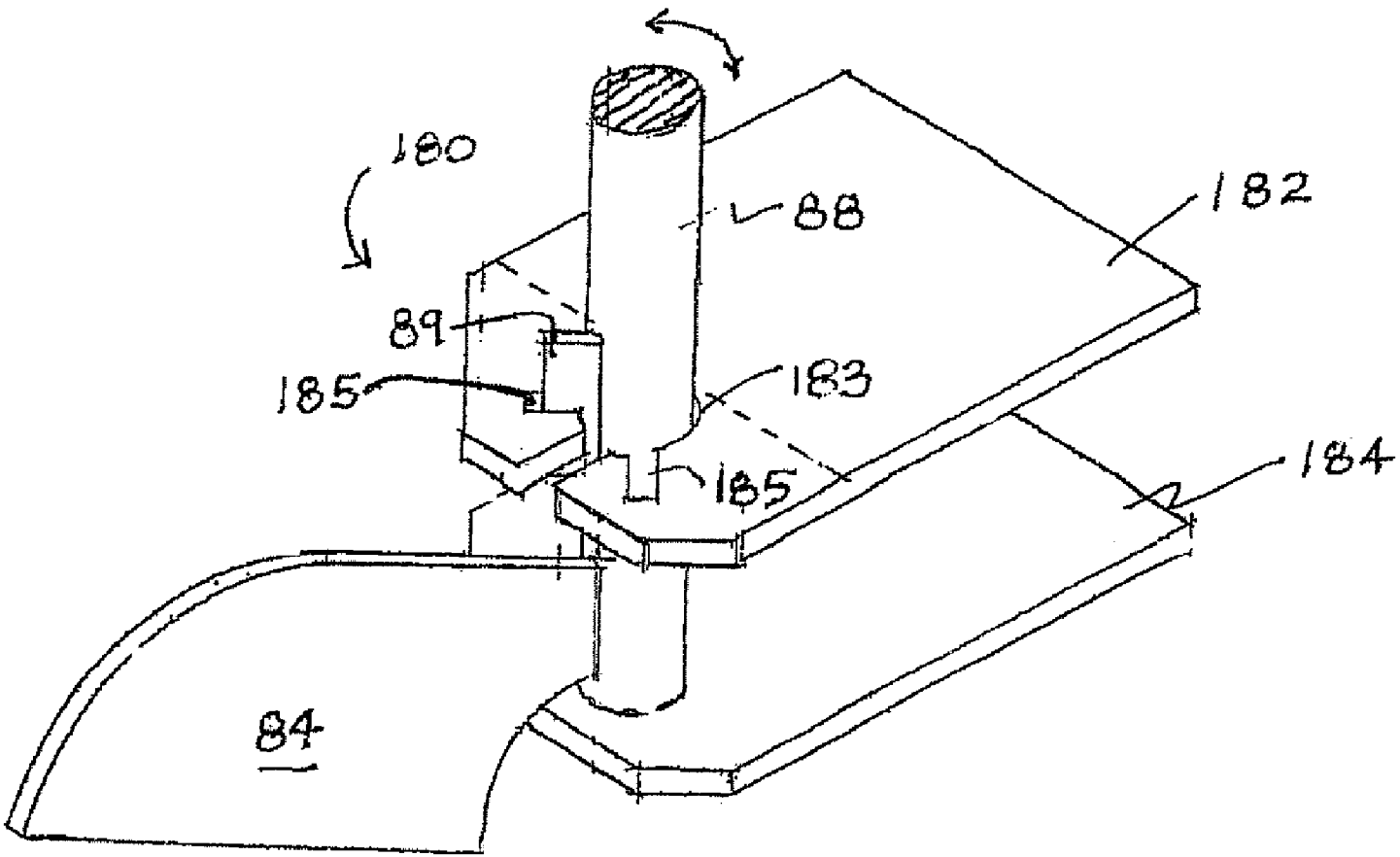
FIG. 8 is an isometric view of a rudder assembly of the watercraft of FIG. 1.

Referring to FIG. 8, the rudder assembly 80 and rudder fixture 180 are shown in greater detail. Upper and lower fixture plates 182, 184 serve as guides for the vertically portion 88 of the handle. These plates are embedded and glued within the aft end 15, 25 of the associated pontoon so as to assume a generally parallel horizontal orientation. The upper fixture plate 182 can have a circular opening 183 configured to receive the vertical portion 88 of the handle. The circular opening 183 can also have a series of radially emanating slots 185 configured to receive a tab member 89 located on the vertically portion 88 of the handle. This slot and tab system can be used to fix the rudder in a desired pre-set orientation to allow hands-free operation once its position has been set. To set the rudder position, the user can lift upward on the gripping portion 84 to disengage the tab 89 from its current slot position. The gripping portion is then rotated to align the tab 89 with the desired new slot position, whereupon the handle can then be lowered to engage the tab 89 with the new slot 185. The lower fixture plate 184 can serve as a vertical stop surface for the rudder and the vertically portion 88 of the handle to maintain the rudder in the desired vertical position after the angular position has been set. In the illustrated embodiment, three slot positions are provided, one each at approximately 4 o'clock, 6 o'clock and 8 o'clock. It will be appreciated, however, this is merely an example and that multiple additional slots or positions could be provided as desired.

Referring again to FIG. 1, one or more seat members 90*a, b* can be provided on and fixed to the pontoons 10, 20 to allow the user to sit down. A removable cushion 92 (FIG. 7) can be provided and configured to fit over the seat members 90*a, b* to lock the members (and the pontoons) together and to provide a more comfortable seating surface. The removable cushion 92 can be stowed when not in use. The cushion 92 can be removably attached to the top of one of the pontoons behind the seat members 90*a, b* using, for example, a hook and loop fastening system (e.g. Velcro®). Additionally, the seat members themselves could be hollow to provide storage space (e.g. used as coolers, etc.)

In an alternative embodiment, a single seat member could be provided, and could be attached to one or both of the pontoons using a hook and loop fastening system, such as Velcro®. The seat member could be attached to one pontoon while the watercraft 1 is being operated, thus allowing the pontoons to move with respect to each other, and could be attached to both pontoons when the user wishes to sit down.

Figure 9A:
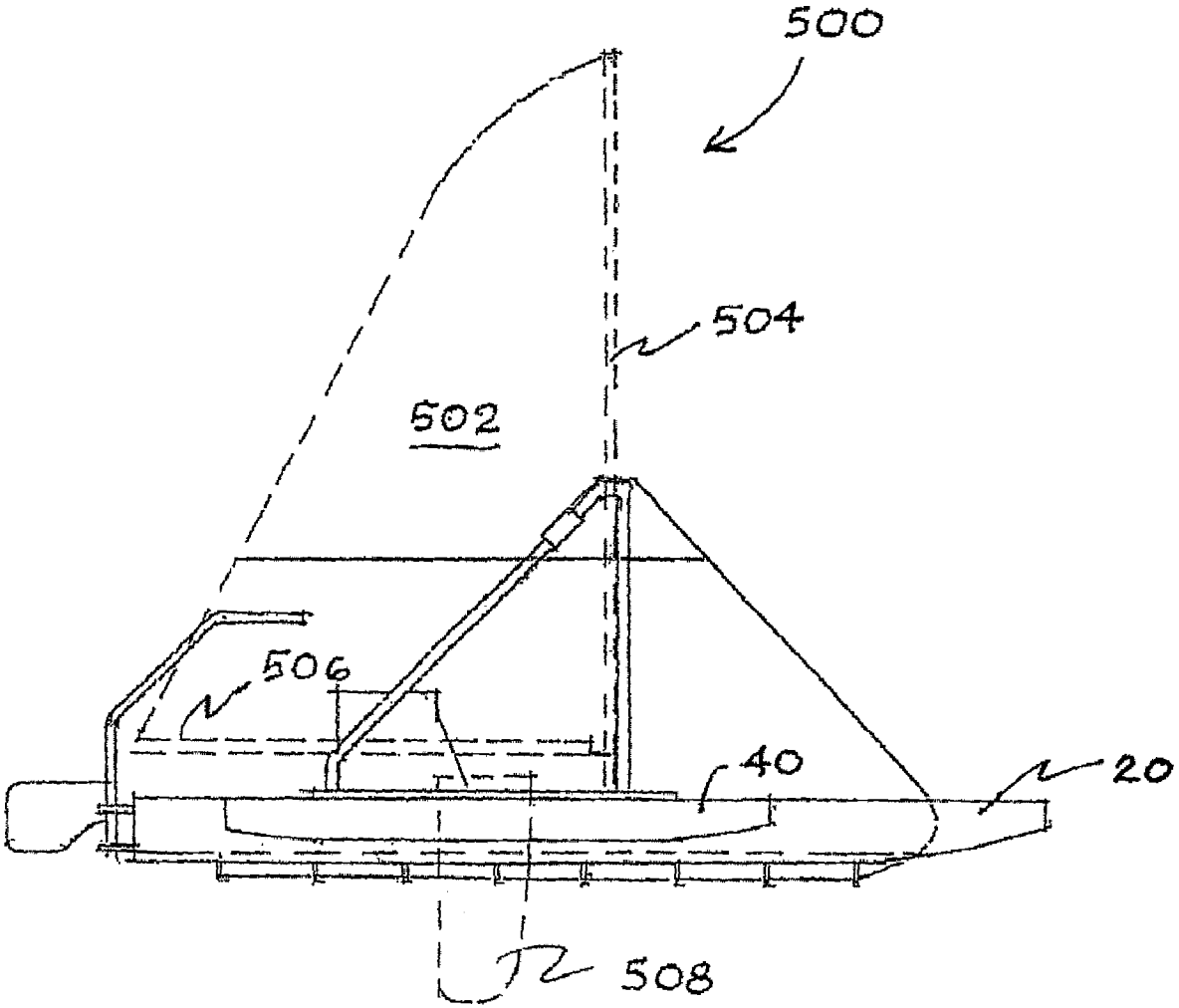
FIGS. 9A and 9B are side and plan views of an alternative embodiment of the watercraft of FIG. 1, incorporating a pair of sail assemblies.
Figure 9B:
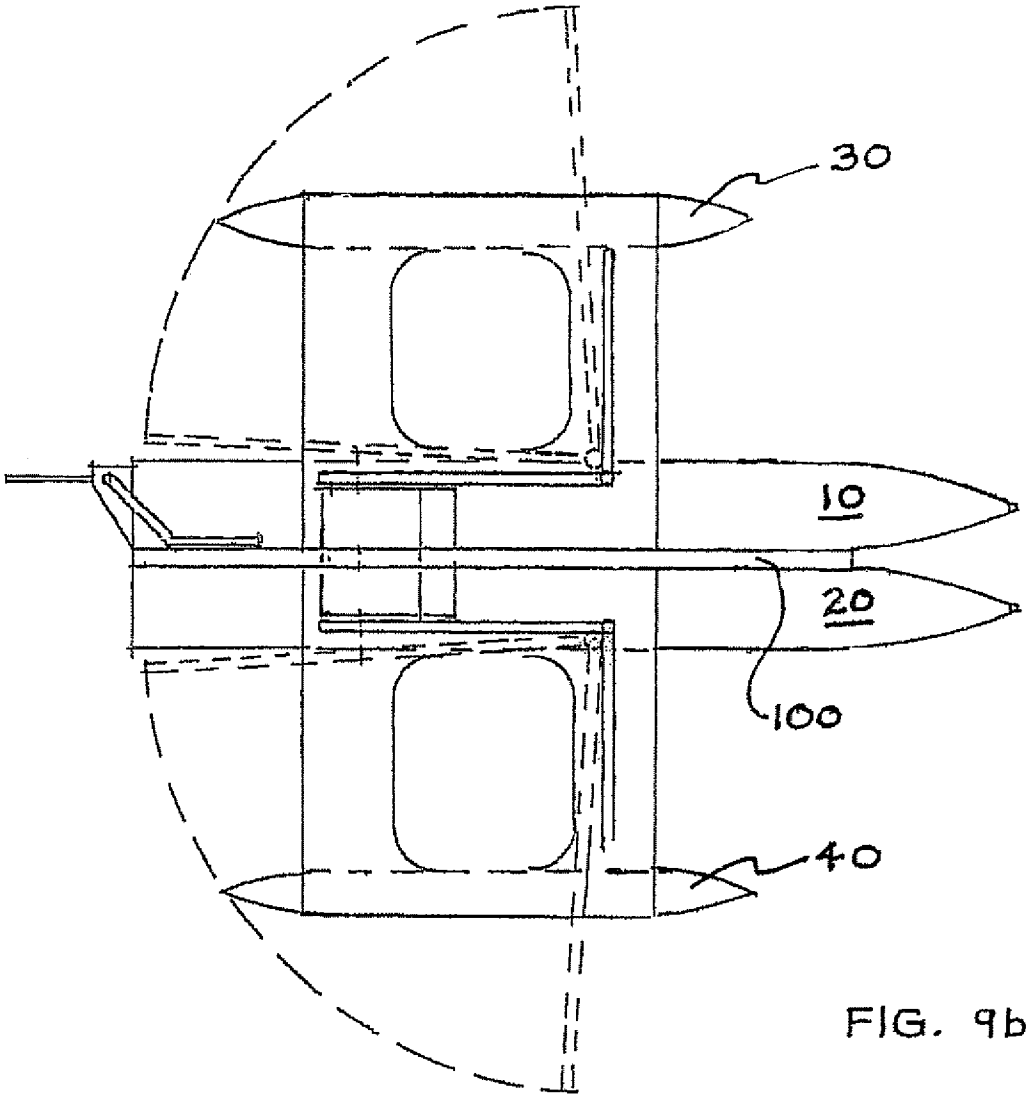

In a further embodiment, illustrated in FIGS. 9A and 9B, the watercraft 1 can be provided with one or more removable sail assemblies 500. In the illustrated embodiment, two sail assemblies are provided 500, one associated with each pontoon 10, 20. This embodiment may be used after locking the pontoons together by placing the cushion member 92 over the seat members 90*a, b* as previously described.

Each sail assembly 500 can comprise a sail 502, mast 504, boom 506 and centerboard 508. The mast 504 can be attached to the surface of the associated outrigger support 32, 42 and can also be attached to the railing 50, 60 at or near their tops. The interconnections between mast 504, boom 506 and sail 502 are well known in the art and thus will not be described in detail. The position of each sail 502 can be controlled with a sheet or line (not shown) that may be cleated to the associated pontoon or outrigger support to maintain the sail's position. Further, a vertical opening can be provided on the other side of each pontoon (and through the associated outrigger supports) configured to receive a centerboard 508. The rudder assembly 80 can be operated either in the lockable mode (as previously described) or in an unlocked mode, in which the user can continually adjust the rudder position as desired.

As can be seen in FIG. 9B, each boom 506 can swing within the 90-degree span between rail members 54, 56. In one embodiment, this swing span is about 85 degrees. As a result, the sails 502 will not swing across to the opposite side of the watercraft 1 when the craft is "coming about." Additionally, since the masts 504 are disposed on opposite pontoons 10, 20, a gap exists between them through which the user can have a clear forward vision. This will be true whether the watercraft 1 is running with the wind or "beating" into the wind.

Due to the presence of the outriggers 30, 40 the sail-equipped watercraft 1 will be extremely stable and will not tip in normal wind conditions. The user may operate the watercraft 1 either sitting on the seat 92 or standing and holding onto the hand railings 50, 60. The masts 504 can be connected to the outrigger supports 32, 42 using socket and pin connections similar to those described in relation to the hand railings 50, 60, and a snap-fitting can be used to connect the mast 504 to the associated hand railing. In one embodiment, a nylon strap could be provided to wrap around the mast and associated hand railing 50, 60, with a snap fitting configured to snap the ends of the strap together. Advantageously, the watercraft 1 can be operated with the sails 502 in the down position and the seat cushion 92 disengaged, so that if the wind dies down, the user can operate the watercraft 1 in the normal standing striding manner.

In one embodiment, the mast 504 can be about 8 feet in length and the boom 506 can be about 5 feet in length.

A tandem version of the disclosed watercraft 1 can also be provided, which would enable the watercraft 1 to be operated by two people at once. The tandem version may have longer and/or larger pontoons than the single person embodiment, although this is not a requirement.

Accordingly, it should be understood that the embodiments disclosed herein are merely illustrative of the principles of the invention. Various other modifications may be made by those skilled in the art which will embody the principles of the invention and fall within the spirit and the scope thereof.

The invention claimed is:

1. A personal watercraft comprising:

first and second flotation members, each flotation member having a longitudinal axis, an inboard coupling edge, a lower water engaging surface and an upper user support surface, said upper user support surface of each element being configured to support a user's foot thereon;

first and second floating outriggers connected to respective first and second flotation members by respective outrigger supports, said floating outriggers being laterally spaced from their respective floatation elements;

first and second hand-supports associated with the first and second flotation members, each of said hand supports comprising a flotation member-connecting portion and a user-gripping portion;

wherein the inboard coupling edges of the first and second flotation members are configured to interconnect so as to enable relative sliding movement of the flotation members in a direction substantially parallel to the longitudinal axis of each flotation member, but to prevent substantial movement of the first and second elements in a direction perpendicular to said longitudinal axis;

wherein one of the inboard coupling edges comprises an outer tubular member and the other inboard coupling edge comprises an inner member, the outer tubular member configured to slidingly receive the inner member therein so that the first and second flotation members can slide relative to each other along their longitudinal axes; and wherein the outer tubular member further comprises a slot oriented substantially parallel to the longitudinal axis of the first flotation member; and wherein the inner member is connected to the inboard coupling edge of the second flotation member via a planar member such that when the outer tubular member receives the inner member, the planar member fits within the slot in the outer tubular member, thus connecting the first and second flotation members in a lateral direction while allowing them to move longitudinally with respect to each other.

2. The personal watercraft of claim 1, wherein the outer tubular member is a hollow cylinder and the inner member is a cylinder.

3. The personal watercraft of claim 1, wherein the outrigger supports are removably connected to the flotation members and the outriggers to allow quick assembly/disassembly of the device.

4. The personal watercraft of claim 1, further comprising a paddle element rotatably disposed on a bottom surface of each flotation members, the paddle element having a rotation axis that is oriented substantially perpendicular to the longitudinal axis of the respective flotation member, wherein the paddle element has an extended position and a retracted position, the element being rotatable between the extended and retracted positions as a result of fluid forces applied to the paddle element during operation.

5. The personal watercraft of claim 4, further comprising a manual paddle actuation feature comprising a connecting element having a first end connected to the paddle element and a second end connected to the first or second hand support, wherein actuation of the connecting element by the user causes the paddle element to maintain a substantially vertical alignment regardless of the fluid forces applied to the paddle element during operation.

6. The personal watercraft of claim 1, further comprising a rudder rotatably connected to at least one of the first and second flotation members, the rudder having a handle positioned adjacent one of the first and second hand supports and an interconnected plate member disposed below a water line of the watercraft.

7. The personal watercraft of claim 1, further comprising a sail assembly having a sail portion and a mast portion, the mast portion engaged with at least one of the first and second flotation members.

8. The personal watercraft of claim 1, further comprising first and second seat elements engaged with the first and second flotation elements, respectively, and a removable seat member configured to engage the first and second seat elements to lock the first and second pontoons longitudinally with respect to each other.

9. A personal watercraft comprising:

first and second flotation pontoons, each pontoon having a longitudinal axis, an inboard edge, a lower water engaging surface and an upper user support surface, said upper user support surface of each element being configured to support a user's foot thereon;

first and second outriggers connected to respective first and second pontoons by outrigger supports;

first and second fixed hand-supports associated with the first and second flotation elements, each of said fixed hand supports comprising a pontoon connecting end and a user-gripping end;

wherein the first and second pontoons are connected via a slip-joint connection comprising a hollow longitudinally oriented outer member connected to the first pontoon and a longitudinally oriented inner member connected to the second pontoon, the inner member sized and configured to be received within the outer to enable relative sliding movement of the first and second pontoons parallel to the longitudinal axis of each pontoon, and to prevent substantial movement of the first and second pontoons in a direction perpendicular to said longitudinal axis;

wherein the outer member comprises a hollow cylinder and the inner member comprises a cylinder, the members sized so that the outer member receives the inner member therein so that the first and second pontoons can slide relative to each other along their longitudinal axes; and wherein the outer member further comprises a longitudinal slot and the inner member is connected to the second pontoon via a planar member, the slot sized to receive the planar member when the inner member is received within the outer member, thereby connecting the first and second pontoons in a lateral direction while allowing them to move longitudinally with respect to each other.

10. The personal watercraft of claim 9, wherein the outrigger supports are removably connected to the flotation members and the outriggers to allow quick assembly/disassembly of the device.

11. The personal watercraft of claim 9, further comprising a first paddle element rotatably connected to a bottom surface of the first pontoon and a second paddle element rotatably connected to a bottom surface of the second pontoon, each paddle element having a rotation axis oriented substantially perpendicular to the longitudinal axis of the respective pontoon, the paddle element further having an extended position and a retracted position, the element being movable between the extended and retracted positions during operation.

12. The personal watercraft of claim 11, further comprising a manual paddle actuation feature comprising a connecting element having a first end connected to one of the first and second paddle elements and a second end connected to one of the first and second fixed hand supports, wherein applying a tension to the connecting element causes the paddle element to maintain a substantially vertical alignment with respect to the associated pontoon, regardless of fluid forces applied to the paddle element during operation.

13. The personal watercraft of claim 9, further comprising a rudder rotatably connected to at least one of the first and second pontoons, the rudder having a handle positioned adjacent one of the first and second fixed hand supports and an interconnected plate member disposed below a water line of the watercraft.

14. The personal watercraft of claim 9, further comprising a sail assembly having a sail portion and a mast portion, the mast portion engaged with at least one of the first and second flotation members.

15. The personal watercraft of claim 9, further comprising a removable seat member configured to be received on a pair of seat supports which are disposed on the first and second pontoons, the seat member configured to lock the first and second pontoons longitudinally with respect to each other.

16. A personal watercraft comprising:

first and second flotation pontoons, each pontoon having a longitudinal axis, an inboard edge, a lower water engaging surface and an upper user support surface, said upper user support surface of each element being configured to support a user's foot thereon;

first and second outriggers connected to respective first and second pontoons by outrigger supports;

first and second fixed hand-supports associated with the first and second flotation elements, each of said fixed hand supports comprising a pontoon connecting end and a user-gripping end;

wherein the first and second pontoons are connected via a slip-joint connection comprising a hollow longitudinally oriented outer member connected to the first pontoon and a longitudinally oriented inner member connected to the second pontoon, the inner member sized and configured to be received within the outer to enable relative sliding movement of the first and second pontoons parallel to the longitudinal axis of each pontoon, and to prevent substantial movement of the first and second pontoons in a direction perpendicular to said longitudinal axis;

wherein each pontoon has at least one keel member attached to an inner or outer side surface thereof.

* * * * *